US010524079B2

(12) United States Patent
Holman

(10) Patent No.: US 10,524,079 B2
(45) Date of Patent: Dec. 31, 2019

(54) DIRECTIVITY ADJUSTMENT FOR REDUCING EARLY REFLECTIONS AND COMB FILTERING

(71) Applicant: Apple Inc., Cupertino, CA (US)

(72) Inventor: Tomlinson M. Holman, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 71 days.

(21) Appl. No.: 15/693,037

(22) Filed: Aug. 31, 2017

(65) Prior Publication Data

US 2019/0069119 A1 Feb. 28, 2019

(51) Int. Cl.

| | |
|---|---|
| ***H04S 7/00*** | (2006.01) |
| ***H04R 1/40*** | (2006.01) |
| ***H04R 5/02*** | (2006.01) |
| ***H04S 3/00*** | (2006.01) |
| ***H04R 5/04*** | (2006.01) |
| ***H04R 3/12*** | (2006.01) |

(52) U.S. Cl.

CPC ..... *H04S 7/305* (2013.01); *H04R 1/403* (2013.01); *H04R 3/12* (2013.01); *H04R 5/02* (2013.01); *H04R 5/04* (2013.01); *H04S 3/008* (2013.01); *H04S 7/301* (2013.01); *H04S 7/303* (2013.01); *H04S 2400/13* (2013.01); *H04S 2400/15* (2013.01)

(58) Field of Classification Search

CPC ..... H04S 7/301; H04S 7/305; H04S 7/303; H04R 1/403; G10L 21/0208

USPC ..... 381/303, 66, 336, 335, 334, 182, 387

See application file for complete search history.

(56) References Cited

U.S. PATENT DOCUMENTS

| | | | | |
|---|---|---|---|---|
| 5,870,484 | A | 2/1999 | Greenberger | |
| 7,130,430 | B2 | 10/2006 | Milsap | |
| 7,881,479 | B2 | 2/2011 | Asada | |
| 8,199,925 | B2 | 6/2012 | Konagai | |
| 8,204,248 | B2 | 6/2012 | Haulick et al. | |
| 9,900,723 | B1 * | 2/2018 | Choisel | H04S 7/305 |
| 2002/0067835 | A1 | 6/2002 | Vatter | |

(Continued)

OTHER PUBLICATIONS

"Digital Sound Projector: PDSP-1", *Pioneer sound.vision.soul: Operating Instructions*, (Jan. 1, 2003), 44 pages.

(Continued)

*Primary Examiner* — Paul Kim
*Assistant Examiner* — Ubachukwu A Odunukwe
(74) *Attorney, Agent, or Firm* — Womble Bond Dickinson (US) LLP

(57) ABSTRACT

A directivity adjustment device that includes a test sound signal generator, a surface detector, and a content processor is described. The test sound signal generator generates test sound signals to scan a listening area (e.g., a room) in a nodding and rotating fashion. The test sounds are emitted by one or more loudspeaker arrays and are sensed by a microphone as they permeate throughout the listening area. The sensed sound is analyzed by the surface detector, to identify reflected sounds in relation to direct sound. Based on the amplitude variance between the peaks that represent the direct and reflected sounds reaching a predefined threshold, an adjusted directivity ratio for the content processor is selected or calculated, which results in a reduction of the level of reflected sounds and corresponding comb filtering effects. Other embodiments are also described.

20 Claims, 11 Drawing Sheets

(56) References Cited

U.S. PATENT DOCUMENTS

| | | | | |
|---|---|---|---|---|
| 2006/0153391 | A1 | 7/2006 | Hooley et al. | |
| 2007/0269071 | A1* | 11/2007 | Hooley | H04R 1/403 381/336 |
| 2008/0226093 | A1 | 9/2008 | Kushida et al. | |
| 2009/0010443 | A1 | 1/2009 | Ahnert et al. | |
| 2011/0002488 | A1 | 1/2011 | Van Daele et al. | |
| 2011/0255702 | A1 | 10/2011 | Jensen | |
| 2016/0309275 | A1* | 10/2016 | Schevciw | H04S 7/301 |
| 2016/0381486 | A1* | 12/2016 | Seo | H04S 7/305 381/303 |
| 2018/0005642 | A1* | 1/2018 | Wang | G10L 21/0208 |

OTHER PUBLICATIONS

"Yamaha :: YSP-1", Retrieved from the Internet <https://www.yamaha.com/yec/ysp1/idx_ysp1.htm, (Jan. 1, 2006), 1 page.

Bech, Soren, "Spatial aspects of reproduced sound in small rooms", *J. Acoust. Soc. Am.*, vol. 103, No. 1, (Jan. 1, 1998), 434-445.

Bech, Soren, "Timbral aspects of reproduced sound in small rooms. I", *J. Acoust. Soc. Am.*, vol. 97, No. 3, (Mar. 1, 1995), 1717-1726.

Bech, Soren, "Timbral aspects of reproduced sound in small rooms. II", *J. Acoust. Soc. Am.*, vol. 99, No. 6, (Jun. 1, 1996), 3539-3549.

Fogle, Benjamin, "Homework 9: Patent Liability Analysis", *Digital Systems Senior Design Project*, (Mar. 21, 2007), 5 pages.

Holman, Tomlinson, "Scaling the Experience", *12th AES International Conference on the Perception of Reproduced Sound*, (Jun. 28, 1993), 232-251.

* cited by examiner

DIRECTIVITY ADJUSTMENT FOR REDUCING EARLY REFLECTIONS AND COMB FILTERING

FIELD

An embodiment of the invention relates to digital signal processing techniques for improving the quality of sound from a loudspeaker that is heard by a listener in the room, using a means of scanning the room for reflections combined with a directivity adjustment to lessen the effect of discrete reflections on the frequency and time responses of the direct sound, thus reducing early arrival comb filtering effects that have been shown to be audible. Other embodiments are also described.

BACKGROUND

Loudspeakers emit sound using a directivity pattern that is generally fixed at manufacture. Arrays of loudspeakers however, driven by digital signal processing that has level control, frequency domain shaping, and time domain adjustment, may be arranged to have controlled or adjustable directivity. Sound emitted from a loudspeaker having such variable directional control properties may be preferentially emitted primarily at a listener in a listening area, but the sound may also extend outwards and toward surfaces in the listening area. After striking a surface, the sound is reflected, and when combined with the direct sound at the listener creates a comb filtering effect that may be audible. This effect is produced by all first-order discrete reflections, but in most instances it is the first-order ceiling and floor reflections that are the most audible. In the case of a loudspeaker located near a wall, such reflections are also particularly audible.

SUMMARY

Sound emitted from a loudspeaker usually reflects off surfaces in a listening area creating acoustic disruptions (i.e., early reflections). For example, these reflected sounds may cause a comb filtering effect that is audible to a listener. To help lessen the impact of reflected sounds and corresponding comb filtering effects, loudspeaker arrays or horn-type loudspeakers are often designed in a factory to be highly directional. Although these loudspeaker arrays or horns may avoid reflecting sounds off surfaces in most listening areas, they are often too directional and do not cover the range of listener locations well. Thus there are at least two competing factors when seeking to improve a listener's experience of sound from a loudspeaker in a room: early reflection control, and coverage of the listening area.

An embodiment of the invention is a directivity adjustment device that includes a test sound signal generator, a surface detector, and a content processor. During a measurement phase or operation, the test sound signal generator generates loudspeaker array input driver signals for producing test sounds in a directional pattern that scans a listening area (e.g., a room) in a nodding (changing pitch angle, or up and down) and rotating (changing yaw angle, or left and right) fashion. These scanning test sound beams are emitted by a loudspeaker array while being sensed by a microphone that may be located at a desired listening position, as the test sounds propagate throughout the listening area. The sensed sound (recorded audio), at each sound beam angle, is then analyzed by the surface detector to, in one embodiment, find the level, spectrum and direction or angle of the test sound beam that causes a deleterious reflection condition at the desired listening position.

A deleterious reflection condition may be found as follows. Multiple peaks in the sensed sound (of a given test sound beam) that may correspond to early reflections off the ceiling and walls, or perhaps also the floor, are identified by a digital signal processing-based, peak detection process that is performed upon the microphone signal. Each reflection peak may be described in terms of the point in time at which it occurs and its amplitude, relative to a peak that corresponds to the direct sound. In other words, the surface detector may compute an estimate of the reflected sounds (sounds reflected off the ceiling, wall and floor in the listening area), and its relation to direct sound (sound that is directly received at the listener from the one or more loudspeaker arrays without reflection). This is an example of what is referred to here as detecting a surface (e.g., ceiling or floor) in the listening area.

The detected difference or variance between the direct test sounds and the reflected test sounds, e.g., in frequency domain or in time domain, is then evaluated by for example comparing the variance to a predefined threshold. A determination is then made based on that comparison, as to whether or not the present test sound beam produces a deleterious reflection condition. For example, if the reflected sound level of the present test sound beam is found to be above a predefined threshold, then the present beam is dismissed (because it does not sufficiently avoid the detected surface) and the measurement process continues with a new, different test sound beam.

The above described trial and error procedure for evaluating a particular test sound beam repeats for multiple test sound beams, where each beam has for example a different combination of level, polar pattern, and angle or direction of principal radiation, in accordance with the nodding and rotating scan, until a test sound beam is found or selected that does not result in the deleterious reflection condition. In other words, a detected surface associated with such a test sound beam is now sufficiently avoided by the test sound beam due to the increased directivity of that test sound beam and due to the angle or direction of its principal radiation. In other words, the amount of sound directed by the speaker array at that surface has now been reduced to a sufficiently low level. This may be evidenced by comparing the amplitude levels of reflection peaks to the amplitude level of the direct peak (which are exhibited in the recording of the test sound beam as it is emitted into the listening area.) One or more characteristics (e.g., polar pattern, principal radiation angle, and/or directivity ratio) of this selected test sound beam is then used in a control operation.

In the control operation, a content processor is configured in accordance with the characteristics of the selected test sound beam (that was selected for having avoided the deleterious reflection condition at the listening position), to produce driver input signals for driving the loudspeaker array. This is referred to here as producing an adjusted, directional sound output pattern, when outputting a listener's sound program content in the listening area. This adjusted directional pattern (beam) is unique for the particular listening area (whose acoustic reflective characteristics were tested or analyzed during the measurement operation.) It may advantageously reduce the level of reflected sounds and corresponding comb filtering effects at the listening position in the listening area, during output of the user's sound program content by the loudspeaker array.

Viewed another way, by having selected a test sound beam that produces a sufficiently reduced amplitude level for a peak that represents reflection off a certain surface in the listening area (which reduction is at least in part due to the selected test sound beam having greater directivity than some others) the control operation is now effectively adjusting the directivity of the speaker array based on that of the selected test sound beam, which should reduce the amount of sound that is directed by the speaker array at the surface. The surface was detected, during the measurement operation, by detection of a particular peak (in the recorded audio) that is attributed to reflection off a surface; the amplitude level of that peak was seen to decrease, down to a predefined threshold, as the test sound beams were made more directional.

In one embodiment, the reduction in the level of reflected sounds and comb filtering effects is advantageously achieved without severely reducing the diffuse sound (from the loudspeaker array) that is heard in the listening area. To do so, the measurement operation may incrementally decrease the directivity ratio (not necessarily the angle or direction of principal radiation) of a candidate, test sound beam (that was found to not create the deleterious reflection condition), and compares the resulting reflected sound level (for each increment) to a predefined threshold, until the reflected sound level is "just above" the predefined threshold, e.g., only 1 dB higher. It is this adjusted directivity that is then used to configure the content processor (for outputting the user's sound program content.) Although such a downward adjustment in directivity may be small, it may advantageously enhance the diffuse sound (while still suppressing the comb filtering effects.)

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. Also, in the interest of conciseness and reducing the total number of figures, a given figure may be used to illustrate the features of more than one embodiment of the invention, and not all elements in the figure may be required for a given embodiment.

DETAILED DESCRIPTION

Several embodiments are described with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1:
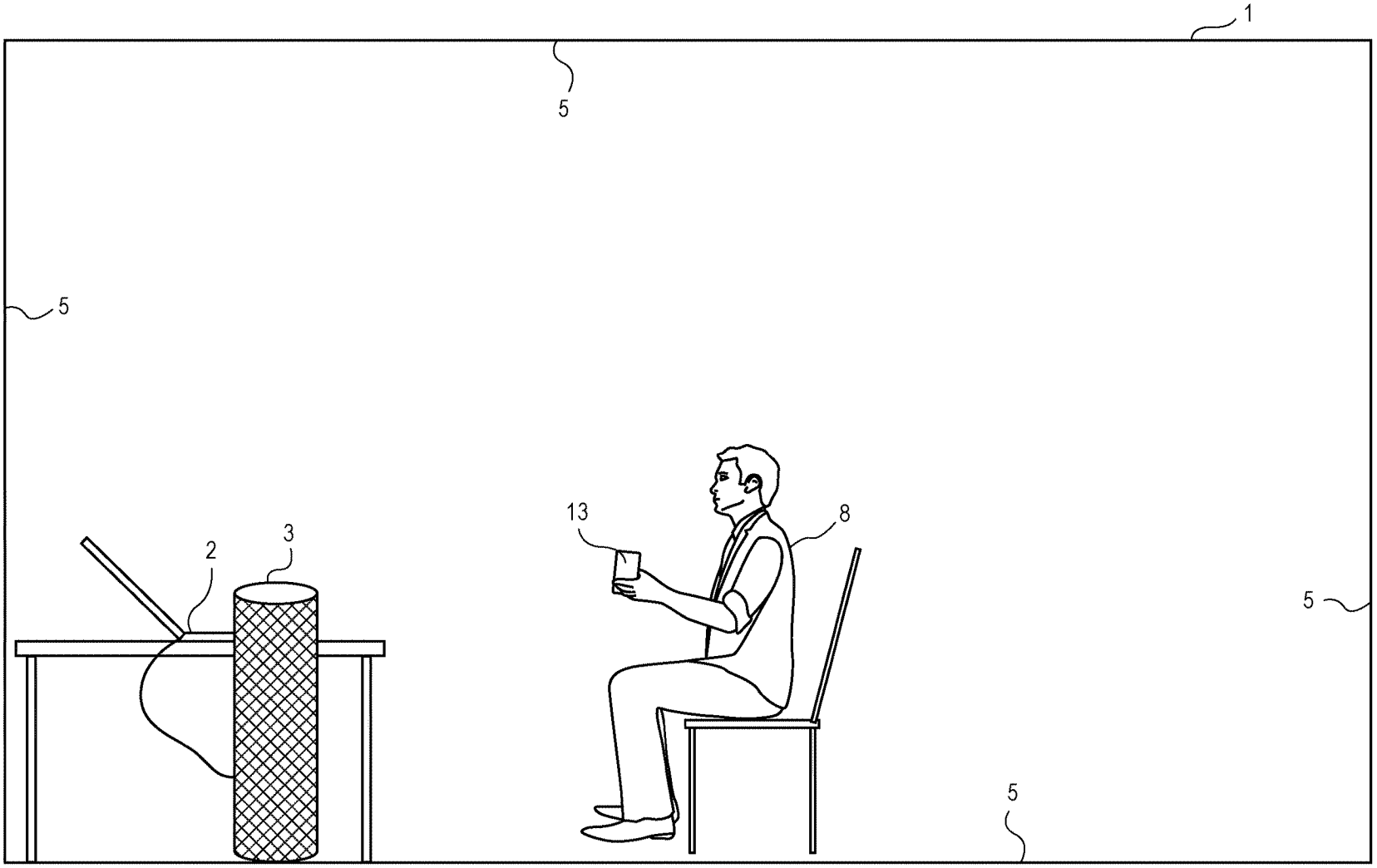
FIG. 1 shows a side view of a listening area in which an audio system measures certain acoustic features of the listening area and on that basis controls directivity of a loudspeaker array, according to one embodiment of the invention.

FIG. 1 shows a side view of a listening area 1 in which there is an audio system having a directivity adjustment device 2 and a loudspeaker array 3. The loudspeaker array 3 is coupled to the directivity adjustment device 2 such that sound program content (e.g., an audio soundtrack of a movie, a musical work) played on the audio system may be emitted or outputted as sound by the loudspeaker array 3 into the listening area 1 with improved sound quality due to tuning of the directivity of the loudspeaker array 3. In one embodiment, the loudspeaker array 3 is contained or integrated in a single loudspeaker cabinet housing as shown, and the tuning of directivity as described below is performed upon the input driver signals of the loudspeaker array 3 only, and not any other loudspeaker cabinets (such as a subwoofer) which might also be outputting a part of the sound program content.

The directivity adjustment device 2 may be implemented as a programmed processor (a digital audio rendering processor) of a laptop computer; however, in other embodiments, the directivity adjustment device 2 may be implemented as a programmed processor of a desktop computer, a netbook computer, a tablet computer, a home audio receiver, a portable music player (e.g., an MP3 player or a cellphone), or a streaming network music player. For example, the directivity adjustment device 2 may be implemented as part of a home audio receiver that receives the sound program content (that is to be played back) wirelessly from an external device such as a laptop computer, a tablet computer, or a smartphone. In another embodiment, the directivity adjustment device 2 is implemented as a programmed processor that is inside the loudspeaker cabinet which houses the loudspeaker array 3, and receives the sound program content in digital or analog form from an external device, either wirelessly or through a wired connection.

Figure 2:
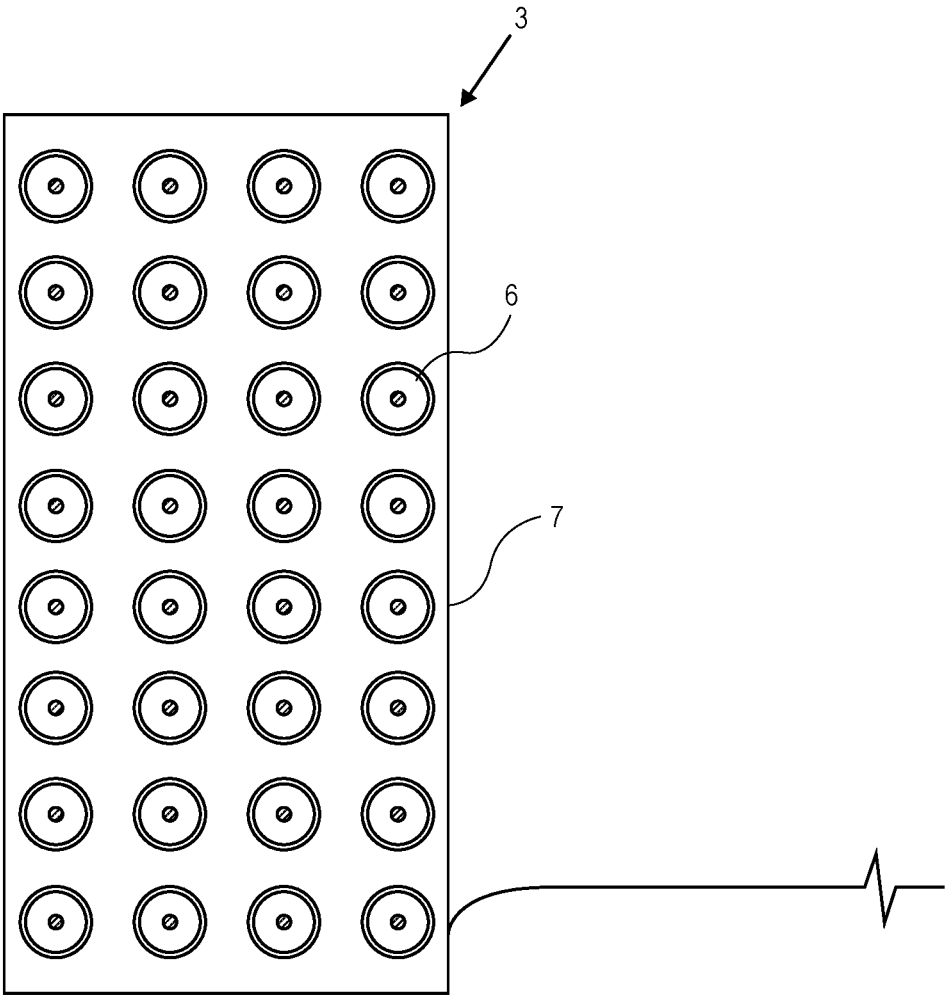
FIG. 2 shows the loudspeaker array with multiple transducers housed in a single cabinet.

FIG. 2 shows a single loudspeaker cabinet 7 in which the loudspeaker array 3 is integrated, as multiple transducers 6. In this example, the loudspeaker array 3 has 32 distinct transducers 6 evenly aligned in eight columns within the cabinet 7. In other embodiments, different numbers of transducers 6 may be used with uniform or non-uniform spacing. The transducers 6 may be any combination of full-range drivers, mid-range drivers, subwoofers, woofers, and tweeters. Each of the transducers 6 may use a lightweight diaphragm, or cone, connected to a rigid basket, or frame, via a flexible suspension that constrains a coil of wire (e.g., a voice coil) to move axially through a cylindrical magnetic gap. When an electrical audio signal is applied to the voice coil, a magnetic field is created by the electric current in the voice coil, making it a variable electromagnet. The coil and the transducers' 6 magnetic system interact, generating a mechanical force that causes the coil (and thus, the attached cone) to move back and forth, thereby reproducing sound under the control of the applied electrical audio signal coming from an audio source, such as the directivity adjustment device 2. Although conventional electromagnetic dynamic loudspeaker drivers are described, those skilled in the art will recognize that in other embodiments other types of loudspeaker drivers, such as planar electromagnetic, and electrostatic drivers may be used.

Each transducer 6 may be individually and separately driven to produce sound in response to separate and discrete audio signals received from an audio source (e.g., the directivity adjustment device 2). By allowing the transducers 6 in the loudspeaker array 3 to be individually and separately driven according to different parameters and settings (including levels, delays, and equalization), the loudspeaker array 3 may produce numerous directivity ratios (e.g., directivity indices) or polar patterns, at numerous angles or directions of principal radiation, where some of these will be found to lessen sound reflections at the listener's ears based on the acoustic characteristics of the listening area 1, as described further below.

In one embodiment, multiple loudspeaker arrays 3 in the listening area 1 may be connected to the directivity adjustment device 2. In such an embodiment, each loudspeaker array 3 may accept its driver input signals from a separate channel of the sound program content, output by the directivity adjustment device 2. For example, in one embodiment five loudspeaker arrays 3 may be used in which three loudspeaker arrays 3 are placed in front left, front right and center positions and two loudspeaker arrays 3 are placed in rear left and rear right positions. The front loudspeaker arrays 3 represent or emit the sound of the respective left, right, and center channels of the sound program content, while the rear left and right channels emit or represent the sound of the respective left and right surround channels of the sound program content. Each of the loudspeaker arrays may have its directivity separately tuned by the directivity adjustment device, as described below using a single loudspeaker array as an example.

The listening area 1 is a location in which the loudspeaker array 3 is located and in which a listener is positioned to listen to sound emitted by the loudspeaker array 3. The listening area 1 may contain one or more surfaces 5, from which sound emitted by the loudspeaker array 3 may be reflected. For example, the listening area 1 may be a room with a ceiling, floor, and one or more walls representing surfaces 5 upon which sound may be reflected from. As will be described in further detail below, the directivity adjustment device 2 adjusts a polar pattern or directivity ratio of the loudspeaker array 3 (when outputting the sound program content) to lessen or avoid potentially undesired early reflections based on the individual characteristics of the listening area 1 (e.g., positioning of surfaces 5 and reflective properties of surfaces 5). By lessening early reflections, the directivity adjustment device 2 diminishes a comb filtering effect that may be perceived by the listener. A comb filtering effect may be perceived by a listener when multiple delayed copies of the same sound sum within a short time interval, and add and subtract level at various frequencies.

The directivity ratio $D_A$ of the loudspeaker array 3 at a target 8 (e.g., listening position) may be represented as $$D_A = 10 \log_{10}\left(\frac{I_q}{I}\right)$$

where $I_q$ is the sound intensity at the target 8 a distance r away from the loudspeaker array 3 and I is the average sound intensity over a spherical surface that is at the distance r from the loudspeaker array 3. The loudspeaker array 3 may be driven with a low directivity ratio $D_A$, which emits direct sound directly at a target 8 (e.g., a listener, or a listening position) but also spreads a relatively high level of sound in other directions that is diffused throughout the listening area 1. The loudspeaker array 3 may alternatively be driven with a high directivity ratio $D_A$, which emits direct sound directly at a target 8 while a relatively low level of sound is emitted in other directions.

Figure 3A:
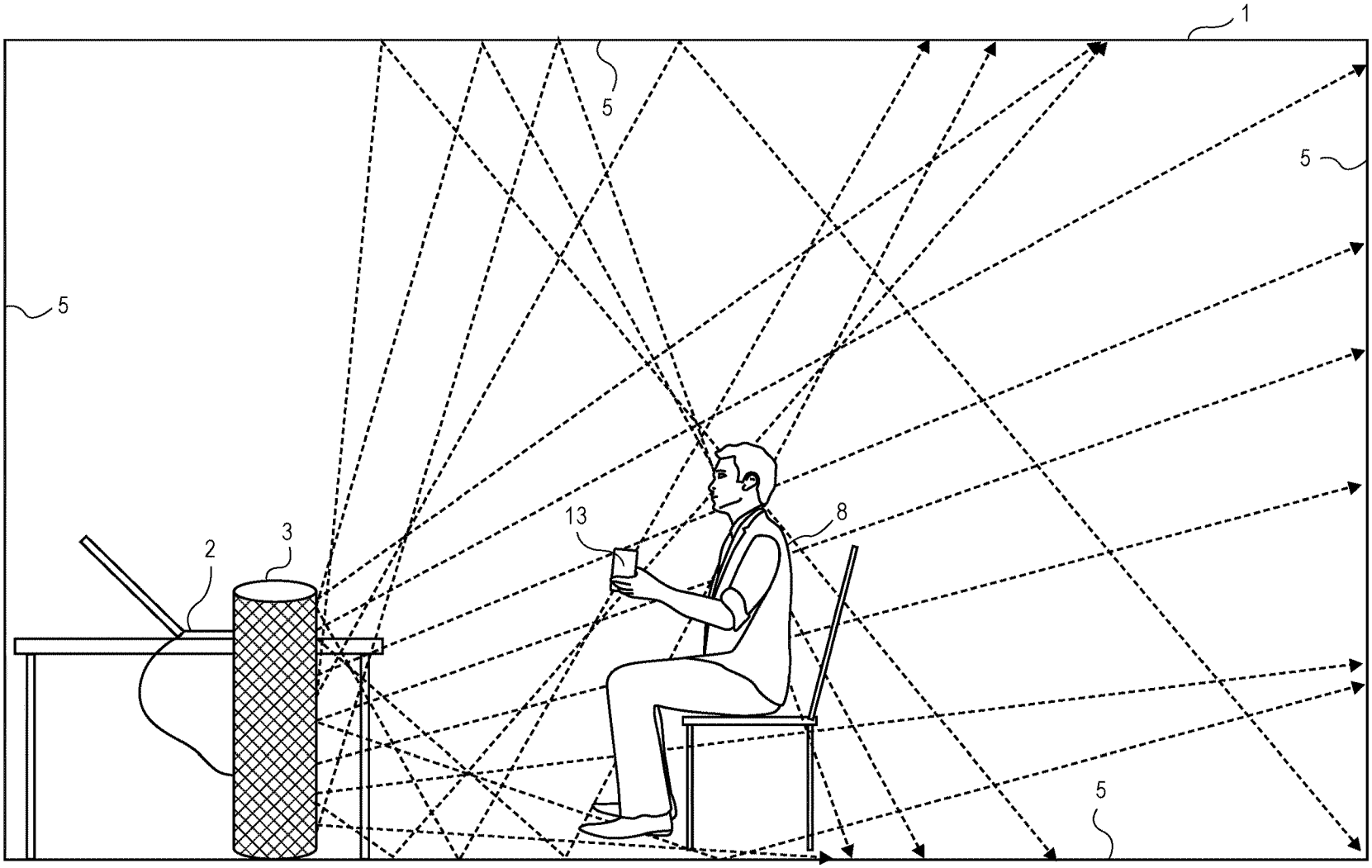
FIG. 3A shows the loudspeaker array producing sound with a low vertical directivity.
Figure 3B:
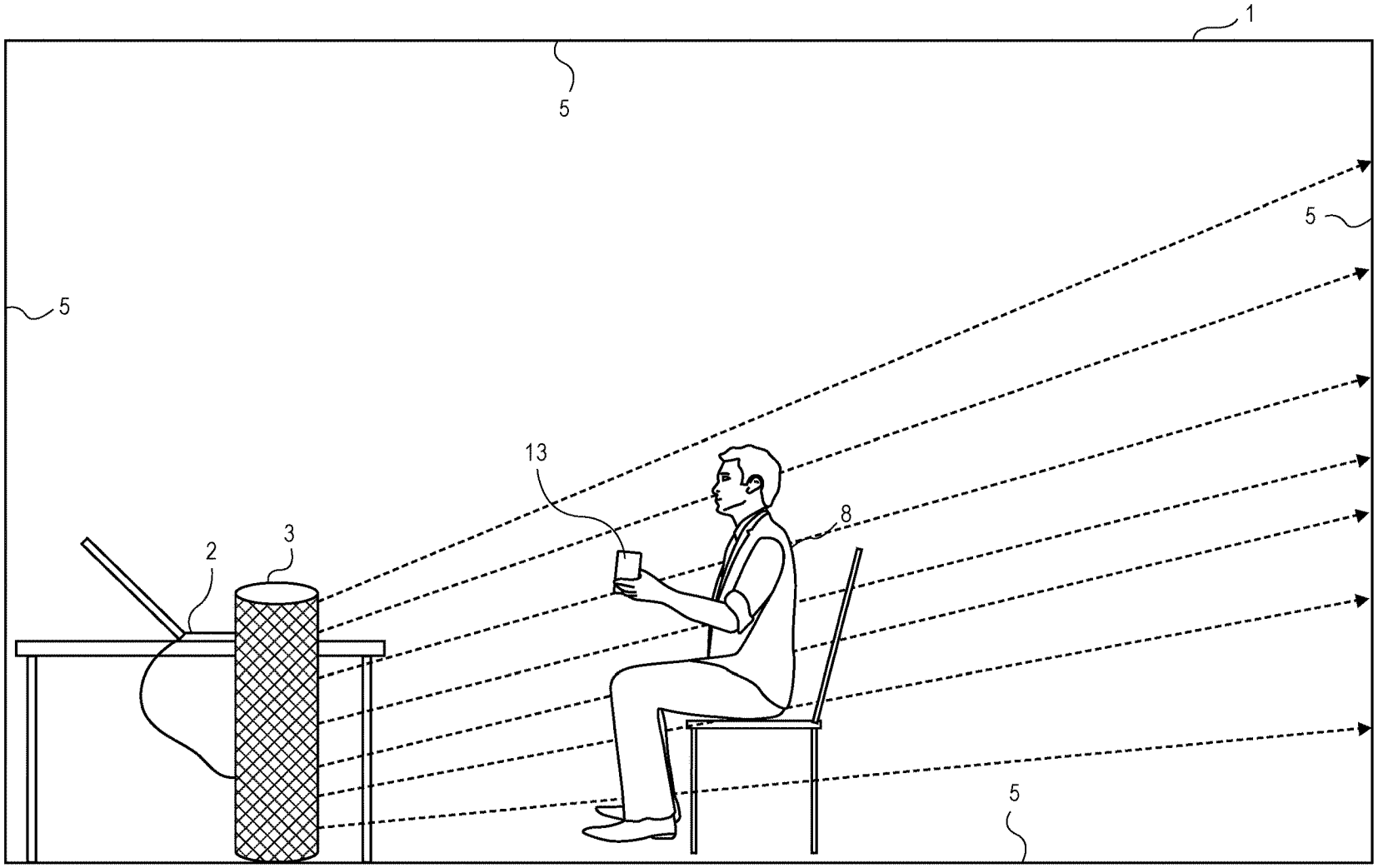
FIG. 3B shows the loudspeaker array producing sound with a high vertical directivity.

The directivity ratio $D_A$ of the loudspeaker array 3 may be divided into separate vertical and horizontal directivity ratios that may be individually calculated and controlled by the directivity adjustment device 2. For example, as shown in FIG. 3A the directivity adjustment device 2 may set a vertical directivity ratio $D_V$ to be low, thereby causing the loudspeaker array 3 to emit in the vertical axis a relatively small amount of direct sound at a target 8 and a large amount of diffuse sound generally into the listening area 1. In contrast, in FIG. 3B, the directivity adjustment device 2 has set the vertical directivity ratio $D_V$ to be high, thereby causing the loudspeaker array 3 to emit in the vertical axis a relatively large amount of direct sound at a target 8 and a small amount of diffuse sound generally into the listening area 1. These two $D_A$ settings may be designed such that each, by itself, causes the loudspeaker array to produce the same total sound level at the listening position.

Figure 4A:
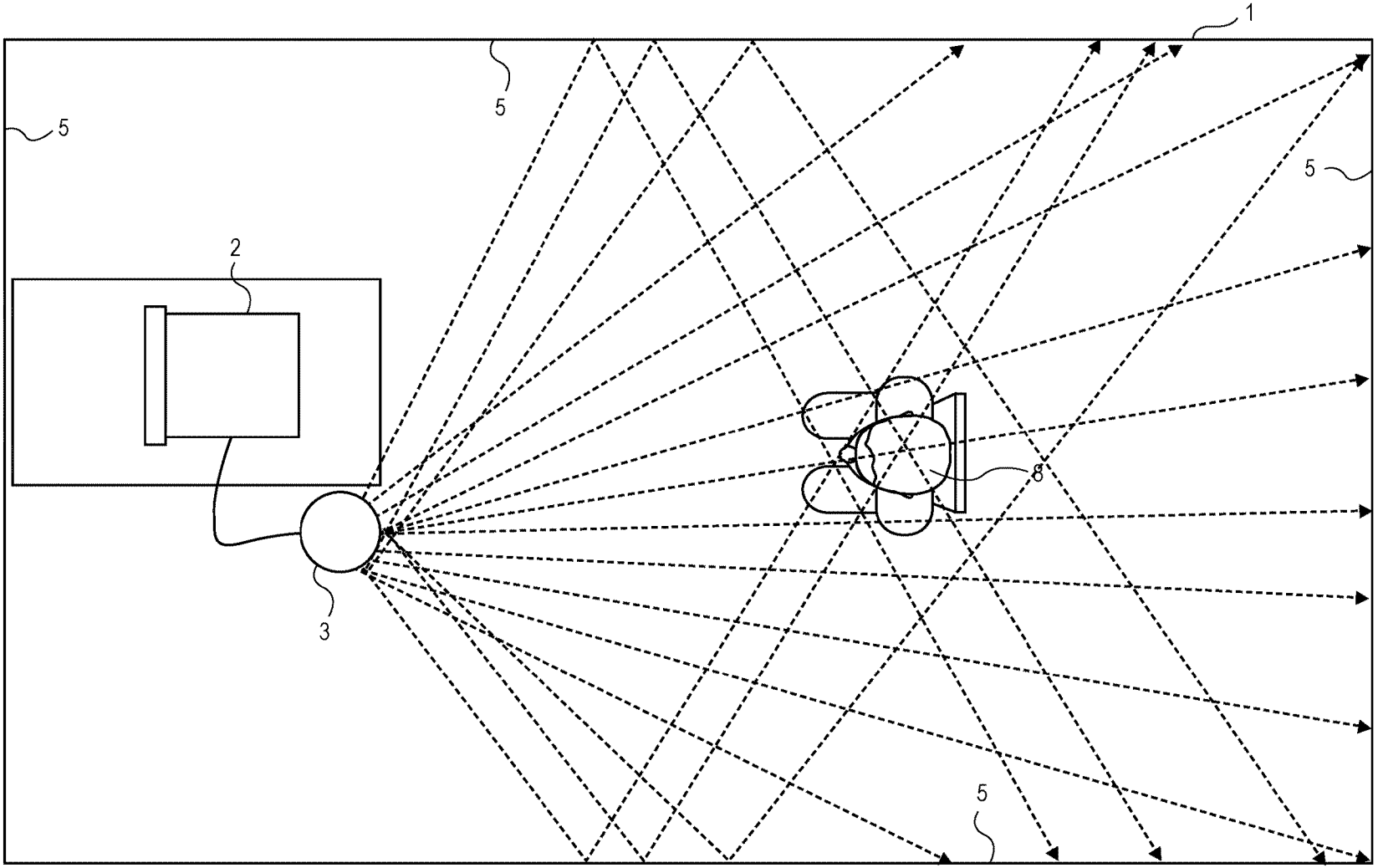
FIG. 4A shows a loudspeaker array producing sound with a low horizontal directivity.
Figure 4B:
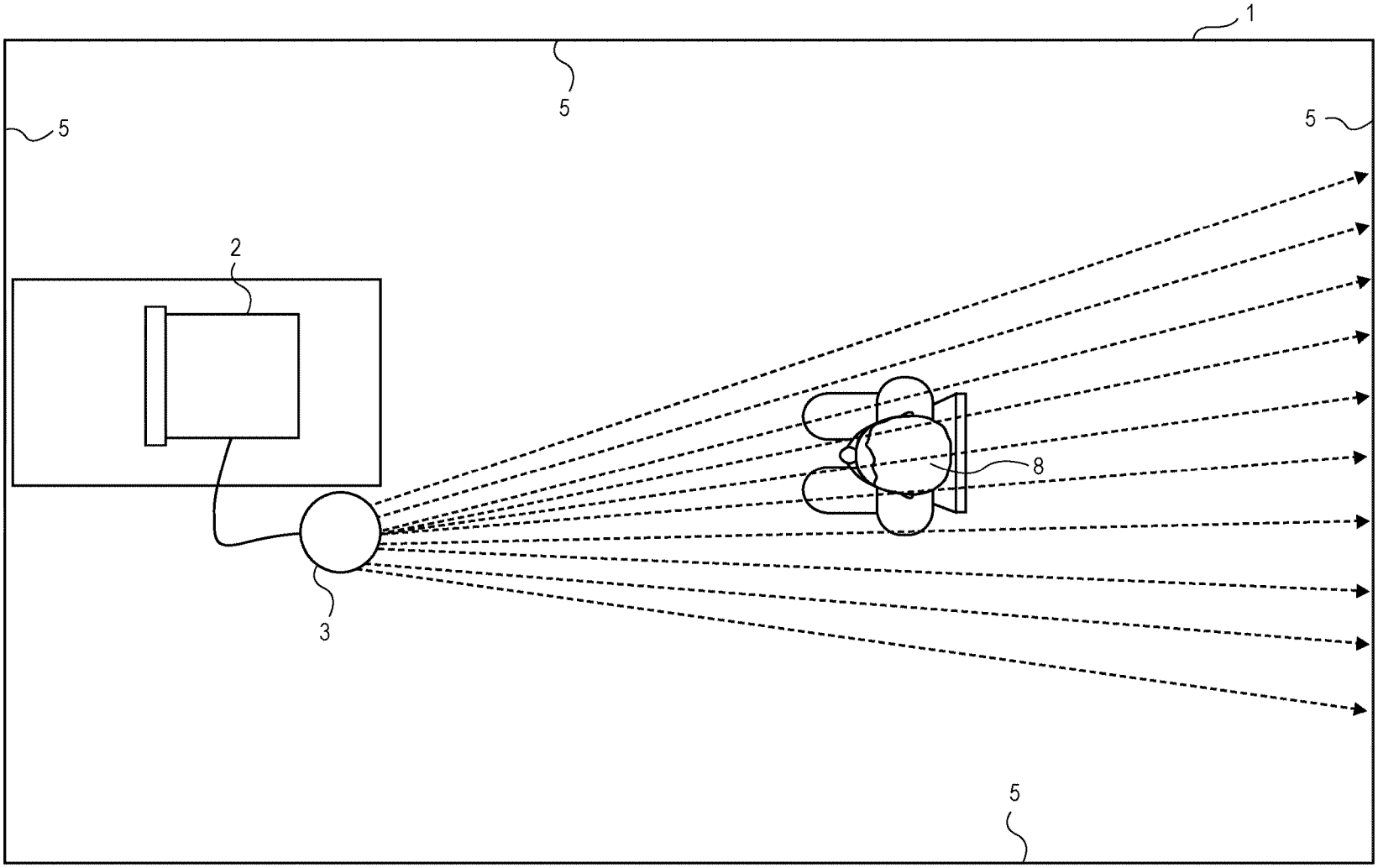
FIG. 4B shows the loudspeaker array producing sound with a high horizontal directivity.

In another example shown in FIG. 4A, the directivity adjustment device 2 may set a horizontal directivity ratio $D_H$ to be low, thereby causing the loudspeaker array 3 to emit in the horizontal axis a relatively small amount of direct sound at a target 8 and a large amount of diffuse sound generally into the listening area 1. In contrast, in FIG. 4B, the directivity adjustment device 2 has set the horizontal directivity ratio $D_H$ to be high, thereby causing the loudspeaker array 3 to emit in the horizontal axis a high amount of direct sound at a target 8 and a low amount of diffuse sound generally into the listening area 1. By splitting the directivity ratio $D_A$ into vertical and horizontal components $D_V$ and $D_H$, the directivity adjustment device 2 may control the loudspeaker array 3 to lessen the amount of sound reflected off either horizontal or vertical surfaces 5 in the listening area 1 separately, and thereby reduce the amount of early reflections based on the characteristics of the listening area. The directivity adjustment device 2 may in some instances decide to adjust both the horizontal and vertical components $D_V$ and $D_H$ of the direcitivity ratio $D_A$.

In one embodiment, the directivity adjustment device 2 increases its output or adjusted directivity ratio (in response to measuring the acoustic characteristics of the listening area, by detecting peaks, in the recorded audio of a test sound beam, that correspond to the direct sound and its early reflections) only so high as needed for the difference between the direct sound and the early reflections to reach predetermined criteria, e.g., −15 dB for 15 msec, or 20 msec. In contrast, when the measured acoustic characteristics indicate that the difference between direct sound and early reflections is too large, the directivity adjustment device 2 decreases its output or adjusted directivity ratio until the difference has reached the predetermined criteria. This may enable the audio system to for example advantageously maintain the diffuse sound at a highest possible level that still allows sufficient suppression of the early reflections (because while increasing the directivity ratio suppresses the early reflections, it will also decrease the diffuse sound.)

In another embodiment, the directivity adjustment device 2, during a measurement operation, determines the direction or angle at which a null in the "vertical" polar radiation pattern of the loudspeaker array should be pointed, so that reflections off the ceiling, at half way between the loudspeaker array and the listening position, are reduced or even minimized (see FIG. 3A.) Similarly, a null in the "horizontal" polar radiation pattern may be determined at which a null is pointed, so that reflections off walls (at half way between the loudspeaker array and the listening position) are reduced or even minimized. This too may enable the audio system to advantageously maintain the diffuse sound at a highest possible level that still allows sufficient suppression of the early reflections. In one embodiment, this direction or angle for a null may be determined to be that of the scanning test sound beam whose recorded audio exhibits the smallest difference between the direct sound and the early reflections.

Figure 5:
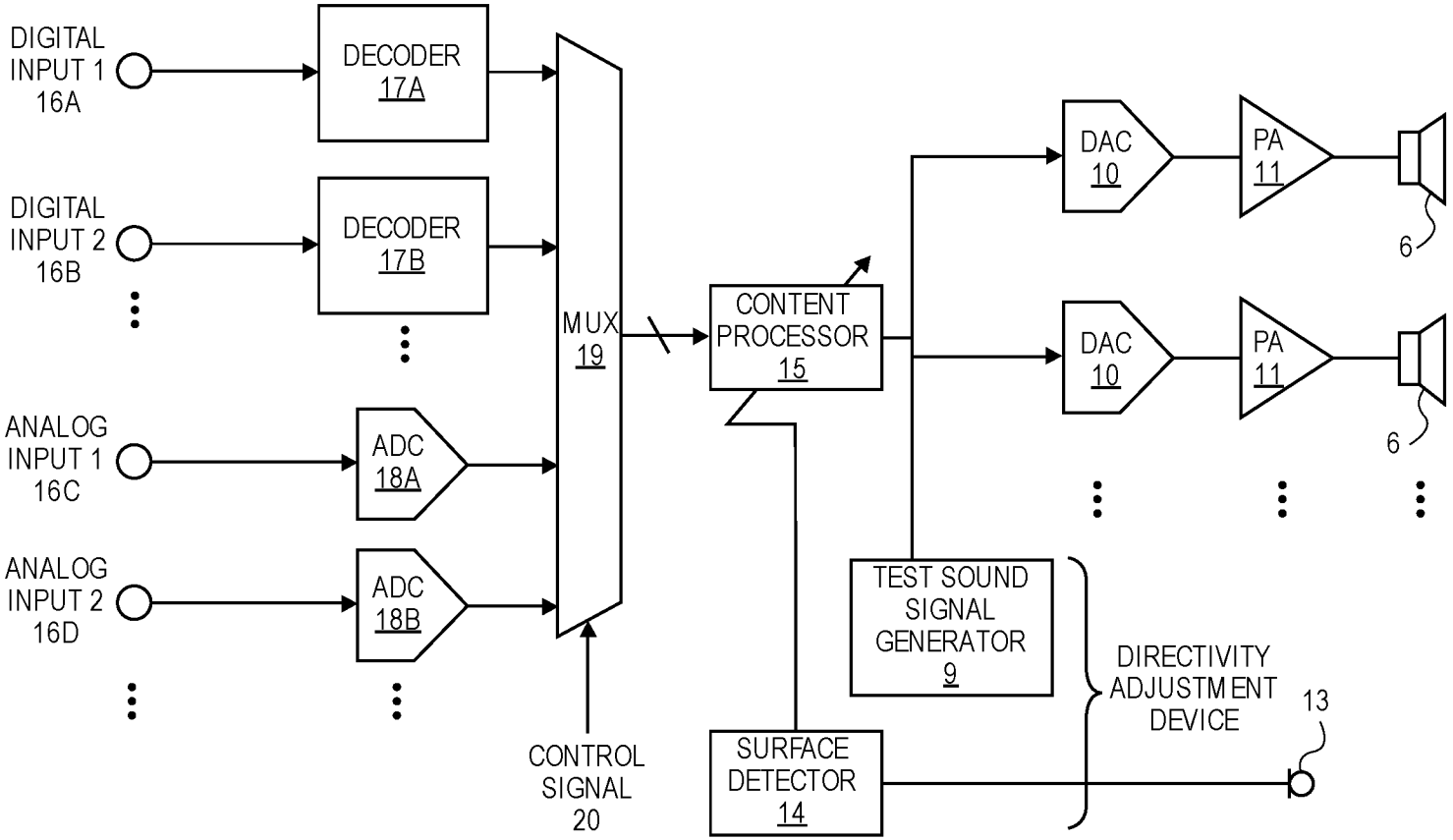
FIG. 5 shows a functional unit block diagram of an audio system including some constituent hardware components of the directivity adjustment device according to one embodiment.

FIG. 5 shows a functional unit block diagram of the audio system that is to output (playback) the users sound program content using a loudspeaker array 3. Some constituent hardware components of the directivity adjustment device 2 are shown, according to one embodiment. The audio system may of course have other components that are not shown. The sound program content may be contained in a stream of audio that may be encoded or represented in any known form. For example, the sound program content may be in an Advanced Audio Coding (AAC) music file stored on a computer or DTS High Definition Master Audio stored on a Blu-ray Disc. The sound program content may be in multiple channels or streams of audio.

There may be multiple inputs 16 for receiving the sound program content using electrical, radio, or optical signals from one or more external audio sources. The inputs 16 may be a set of digital inputs 16A and 16B and analog inputs 16C and 16D including a set of physical connectors located on an outside surface of an electronics enclosure or housing. For example, the inputs 16 may include a High-Definition Multimedia Interface (HDMI) input, and an optical digital input (Toslink). In another embodiment, the directivity adjustment device 2 receives the sound program content through a wireless connection with an external audio source. In this embodiment, the inputs 16 include a wireless adapter for communicating with the external audio source using wireless protocols. For example, the wireless adapter may be capable of communicating using Bluetooth, IEEE 802.11x, cellular Global System for Mobile Communications (GSM), cellular Code division multiple access (CDMA), or Long Term Evolution (LTE).

A decoder 17A or 17B is to decode the sound program content arriving in electrical, optical, or radio signals, into a set of audio channels representing the sound program content. For example, the decoder 17 may receive a single signal containing six audio channels (e.g., a 5.1 signal) and decompress to undo a bitrate reduction or undo a storage or transmission format conversion of the signal, into six audio channels. The decoder 17 may be capable of decoding an audio signal encoded using any codec or technique, including Advanced Audio Coding (AAC), MPEG Audio Layer II, MPEG Audio Layer III, and Apple Lossless Audio Codec (ALAC).

As to the analog inputs 16C and 16D, each analog signal received by analog inputs 16C and 16D represents a single audio channel of the sound program content. Accordingly, multiple analog inputs 16C and 16D may be needed to receive the sound program content. The input analog audio channels may be digitized by respective analog-to-digital converters 18A and 18B to form digital audio channels.

The digital audio channels from each of the decoders 17A and 17B or the analog-to-digital converters 18A and 18B are output to a multiplexer 19. The multiplexer 19 selectively outputs a set of audio channels based on a control signal 20. The control signal 20 may be received from a control circuit or processor in the directivity adjustment device 2 or from an external device. For example, a control circuit controlling a mode of operation of the directivity adjustment device 2 may output the control signal 20 to the multiplexer 19 for selectively outputting a set of digital audio channels.

The multiplexer 19 feeds the selected digital audio channels to a content processor 15 which then digitally renders them, to produce a set of transducer driver signals for driving the transducers 6. This digital rendering may have operations in time domain and/or in frequency domain (e.g., using transforms such as the Short Term Fourier Transform (STFT), for example, to convert into frequency domain.

The content processor 15 may perform various digital audio or signal processing routines on the input digital audio channels to adjust and enhance the sound program content in the channels to suit the particular playback subsystem including the loudspeaker array 3 and the acoustic environment (listening area 1.) The audio and signal processing may include directivity adjustment (beam forming, including polar pattern or directivity ratio adjustments and principal radiation angle adjustments), noise reduction, and spectral shaping (e.g., equalization.)

In one embodiment, the content processor 15 adjusts the directivity of the audio input channels that are rendered and then played through (or output by) the loudspeaker array 3, according to the adjusted directivity ratio and/or polar pattern that it has received from the surface detector 14. The content processor 15 produces the resulting transducer driver input signals, for example by determining delay and energy settings used to output segments of the input channels through the selected transducers 6 so as to meet the specified directivity ratio or polar pattern. The selection and control of a set of transducers, including delays and energy levels applied to the input channels to form the transducer driver signal, allows the segment to be output according to the specified, adjusted directivity, which is expected to reduce early reflections and comb filtering effects for each listening area 1.

As shown in FIG. 5, the processed segment of the sound program content (or the resulting transducer or driver input signals) are passed from the content processor 15 to the digital-to-analog converters 10 which in turn feed the power amplifiers 11 that drive the selected transducers 6 of the loudspeaker array 3. Here, it should be noted that in one embodiment, the loudspeaker cabinet 7 in which the loudspeaker array 3 is integrated (see, e.g., FIG. 2) also contains the content processor 15, the directivity adjustment device 2, the digital to analog converters 10, and the audio power amplifiers 11 that drive the individual sound output transducers 6 that make up the array 3; in such an embodiment, the sound program content that is input to the content processor 15 may be received form an external device through a detachable, digital communications cable (e.g., a Universal Serial Bus cable) that may be attached to an externally accessible connector that is built into the loudspeaker cabinet 7, or through a digital audio communications wireless interface, e.g., a wireless local area network connection.

Figure 6A:
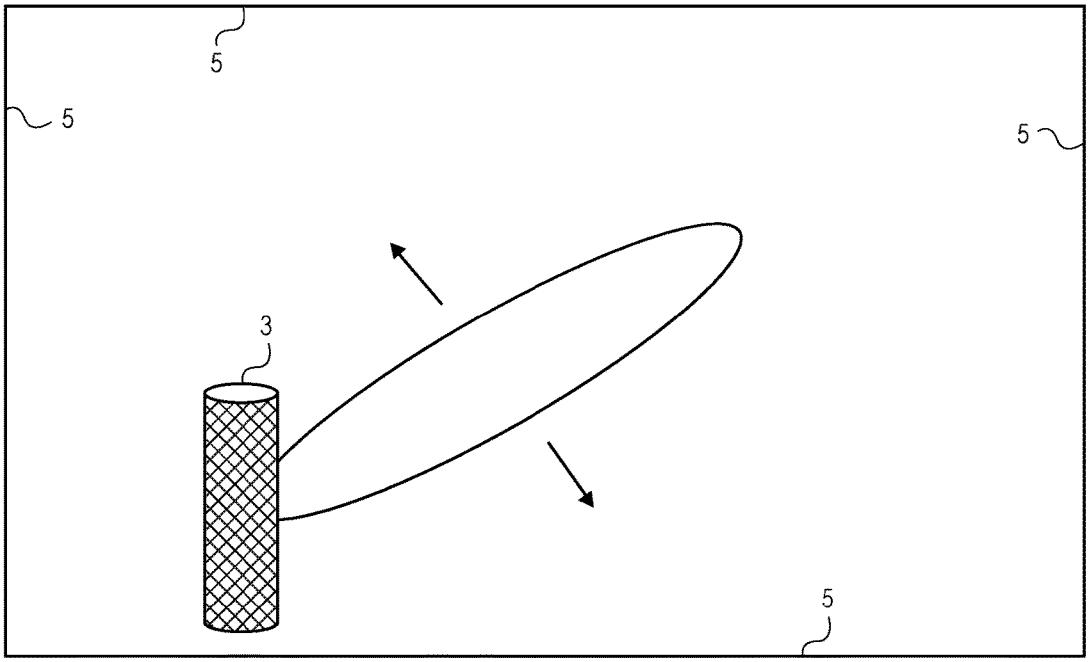
FIG. 6A shows a loudspeaker array emitting a high directivity test pattern in a certain frequency range, which is being moved in a vertical or "nodding" manner, to scan the listening area.
Figure 6B:
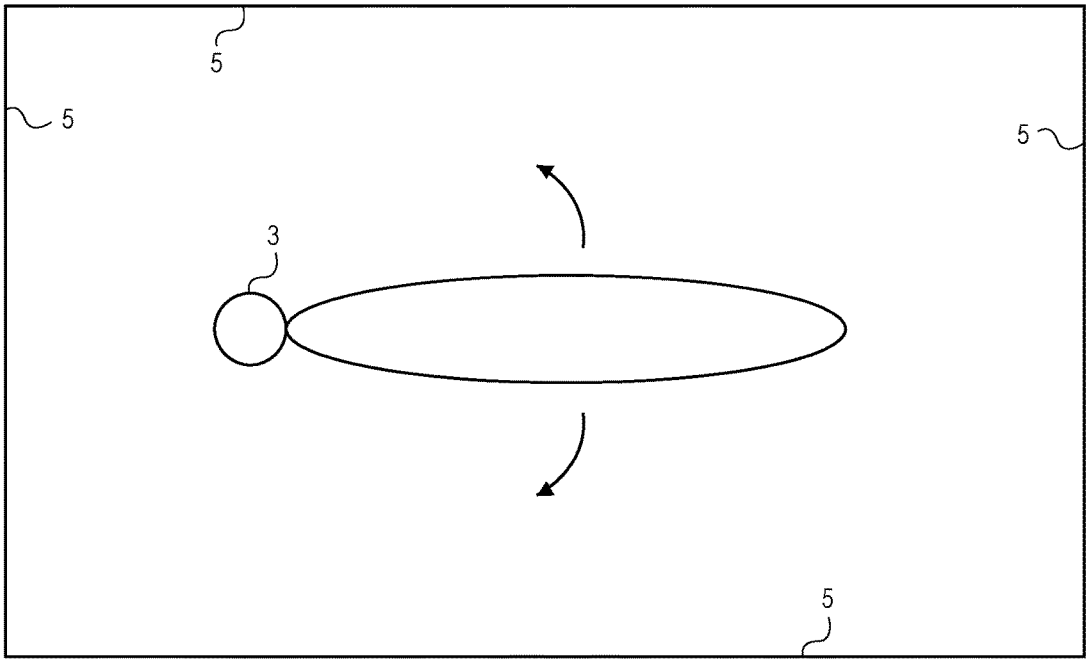
FIG. 6B shows the loudspeaker array emitting a high directivity test pattern in a certain frequency range, which is being rotated in a horizontal or left-right manner, to scan the listening area.

The directivity adjustment device 2 includes a test sound signal generator 9 for creating the transducer driver signals that drive the loudspeaker array 3 for outputting the test sound beams in the listening area 1. In one embodiment, the test sound signal generator 9 produces audio clips in digital form that are fed to digital-to-analog converters 10. The analog signals generated by the digital-to-analog converters 10 are transmitted to power amplifiers 11 to drive the transducers of the loudspeaker array 3. The loudspeaker array 3 outputs the audio clips as test sounds into the listening area 1. Using filters (for spectral shaping), delays, and energy level adjustments, the test sound signal generator causes highly directed test sound beams (e.g., as directive as possible given the characteristics of the loudspeaker array and the audio frequency range) to be rotated around the listening area 1 both horizontally and vertically to create a nodding (up-down) and rotating (left-right) effect. For example, as shown in FIG. 6A, a high directivity test pattern may be moved in the vertical direction (e.g., alter the vertical angular position of the directivity pattern) in a "nodding" or up and down manner to scan the listening area 1. Similarly, FIG. 6B shows the high directivity test pattern being moved in the horizontal direction (e.g., alter the horizontal angular position of the directivity pattern) or in a left and right manner to scan the listening area 1. The nodding and rotating high directivity test sound beam results in reflections off the surfaces 5 which may include a ceiling, a floor, walls, or other objects. Upon encountering a surface 5, a test sound is reflected. These reflections are sensed and analyzed as described below during the measurement operation, based on which the directivity adjustment device 2 calculates or selects an adjusted directivity (a directivity ratio, a polar pattern or both) for the loudspeaker array 3 that lessens reflections and comb filtering at the target 8. Note here that these test sounds may be selected to have their primary spectral content in some intermediate part of the human audible frequency range (not at the lowest, and not at the highest, e.g., in the range of 2 kHz-8 kHz) that is suitable for producing a sufficiently directive, test beam pattern for use during the measurement operation.

The directivity adjustment device 2 uses the microphone 13 for sensing sounds in the listening area 1. For example, the microphone 13 may be integrated into a larger portable device, such as a smartphone or a headset that can be easily carried by the listener—see FIG. 1. The microphone 13 senses the test sounds that are directly output by the loudspeaker array 3 and also senses the test sounds after they have been reflected off surfaces 5 in the listening area 1. Although shown and described as a single microphone 13, in one embodiment, the directivity adjustment device 2 may be configured to use the recorded audio from multiple microphones 13 or a microphone array, for detecting the sounds in the listening area 1. The microphone 13 may be omnidirectional, and may be any suitable type of acoustic-to-electric transducer or sensor, including a Micro Electrical-Mechanical System (MEMS) microphone, a piezoelectric microphone, an electrostatic microphone, or an electrodynamic microphone. The microphone 13 may alternatively be directional, providing a range of polar patterns, such as cardioid or figure eight. In one embodiment, the polar pattern of the microphone 13 may vary continuously over frequency.

The microphone 13 may be integrated into a housing of a computing device in which the directivity adjustment device 2 is implemented as a programmed processor. Alternatively, it may be external to the housing of the directivity adjustment device 2 as shown in FIG. 1, and in that case may coupled to the device 2 through the use of a wired or wireless digital communication link. For example, the microphone 13 may be connected to deliver its output audio microphone signal to the directivity adjustment device 2 through the use of a WiFi or Bluetooth transceiver. By being physically separate from the housing inside which the directivity adjustment device 2 is implemented, the microphone 13 may be placed at the target 8 in the listening area 1 (i.e., a location where a user is or intends to sit in the listening area 1) such that the measurements for the directivity adjustments are relative to this target 8.

Figure 7:
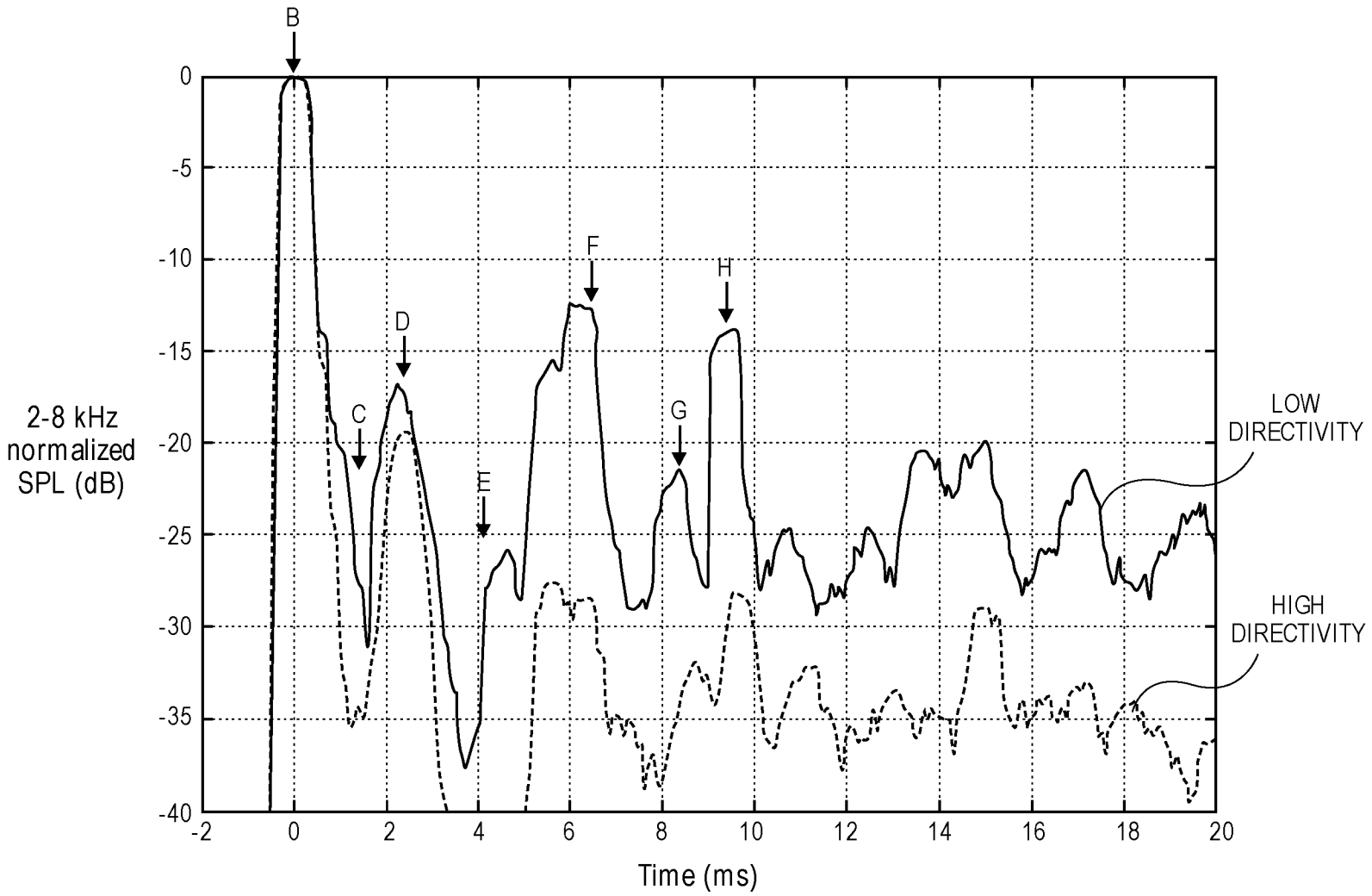
FIG. 7 shows amplitude-time plots (in dB vs. time) of samples of sensed sounds in the 2-8 kHz range, measured using a microphone in the listening area, while the loudspeaker array is emitting in accordance with a wide polar pattern (and a corresponding low directivity ratio) and while the loudspeaker array is emitting in accordance with a narrow polar pattern (and a corresponding high directivity ratio.)

The directivity adjustment device 2 also includes a surface detector 14 that in conjunction with the test sound signal generator 9 operate during the measurement operation described above, to compute an adjusted polar pattern, an adjusted directivity ratio, or both, for use by the content processor 15. The surface detector 14 determines the presence and effect of surfaces 5 in the listening area 1 based on analyzing the sensed sounds (the audio signal received from the microphone 13). In one embodiment, the surface detector 14 samples the sensed sounds from the microphone 13, for example, in a 20 msec stream of sensed sounds received from the microphone 13 as shown in FIG. 7 (where the surface detector 5 may take 500 sample points.) An amplitude-time plot 21A of sample points taken in a 20 ms segment of the sensed test sounds stream is shown, with the first arriving sound from the loudspeaker array to the microphone occurring at 0 ms, having subtracted the air flight time from the loudspeaker array to the microphone. The surface detector 14 may detect a direct sound and several reflected sounds produced by the loudspeaker array 3 in the listening area 1, by locating amplitude peaks (above general background noise) in the amplitude-time plot 21A. These are also referred to as early reflections. Peak B in the plot is seen to be the earliest amplitude peak and may therefore represent test sounds directly received from the loudspeaker array 3 without reflection ("direct sound".) Peaks later in time may represent sounds reflected off surfaces 5 in the listening area 1 ("reflected sounds"), where these are seen to be lower amplitude peaks, e.g., lower than the earliest amplitude peak. As shown in FIG. 7, the direct test sounds represented by peak B are sensed by the microphone 13 before, or arrive earlier in time than, the reflected sounds at peaks D, F, and H. In this example, peak D may represent reflections from the floor, peak F may represent reflections from a ceiling, and peak H may represent reflections from walls in the listening area 1. Additional background noises are sensed in troughs C, E, and G (between the peaks at D, F and H) in the amplitude-time plot 21A.

Although the highest peak in the amplitude-time plot 21A may be used to represent direct sounds, in some situations reflected sounds may gain energy during or after reflection (e.g., by being reflected off a concave curved surface). Accordingly, using the first peak in the amplitude-time plot 21A above general background noise eliminates potential confusion as to a reflected sound with higher than normal energy.

FIG. 7 also shows an amplitude-time plot 21B of sample points taken in the same 20 msec segment of sensed sounds received from the microphone 13, only now with the directivity ratio of the loudspeaker increased. Despite the loudspeaker array and the microphone being in the same listening room and at the same locations, the levels of the reflections in plot 21B are now significantly lower, due to the directivity increase. This shows that in order to reduce the impact of early reflections and comb filtering to a less perceivable or disruptive level, an adjusted polar beam pattern (or corresponding directivity ratio) can be calculated by the surface detector 14 for the loudspeaker array 3, that creates a more directed sound toward the target 8; By doing so in compliance with certain criteria, e.g., maintaining the reflections to be no stronger than −15 dB+/−1 dB, relative to the sensed direct sound, for a time interval of 15 msec, or 20 msec, from the start of the sensed direct sound, the maximum permissible level of diffused sound in the listening area 1 is also maintained. This −15 dB level (over a 15 msec or 20 msec time interval) is also referred to here as a predefined amplitude variance level or threshold.

In one embodiment, the surface detector 14 may calculate an adjusted (increased) directivity ratio, or a more directive polar pattern, for the loudspeaker array 3, when (and in response to) the predefined amplitude variance level or threshold being exceeded by any one of the detected reflected sounds (detected peaks in a given time interval starting with the detected direct sound, e.g., 15 msec, or 20 msec.) To illustrate using the amplitude-time plot 21B as an example, the reflected sounds and their variances relative to the direct sounds are shown in the table below.

| Reflected Sound Peak | Amplitude Level | Direct Sound Amplitude Level (Peak B) | Variance |
|---|---|---|---|
| D | −17 dB | 0 dB | −17 dB |
| F | −12 dB | 0 dB | −12 dB |
| G | −22 dB | 0 dB | −22 dB |
| H | −14 dB | 0 dB | −14 dB |

In this example, the variance of the reflected sound corresponding to peak F is greater than the predefined amplitude level (e.g., variance −12 dB is greater than the predefined amplitude level −15 dB). This is interpreted as—referring briefly to FIG. 1—as follows: the surface 5 that has been detected as a peak F does interfere with the direct sounds, causing a disruptive comb filtering effect (according to the −15 dB criteria.) However, the variance between the direct sounds corresponding to peak B and the reflected sounds corresponding to peaks D and G is less than the predefined amplitude level of −15 dB (e.g., variances −17 dB and −22 dB are less than the predefined amplitude level −15 dB). Thus the peaks at D and G are below the criteria level, and are deemed inaudible.

Since the surfaces 5 in the listening area 1 corresponding to peaks F and H produce reflected sounds with relatively high energy level, (in relation to the direct sounds corresponding to peak B), these reflected sounds are likely to cause a perceivable comb filtering effect. In response, the surface detector 14 may calculate or select an adjusted (here, increased) directivity ratio that lessens the amount of sound directed by the loudspeaker array 3 at the surfaces 5 corresponding to peaks F and H. This produces reduced energy reflected sounds (as may be measured from the recorded audio produced by the microphone 13 while a test sound beam having that adjusted directivity ratio is being emitted). The reduced energy reflections consequently increase the amplitude variances/differences between the direct sounds and the reflected sounds. By increasing the directivity of the loudspeaker array 3, the difference between the direct sound peak and the reflected sound peaks is increased to, e.g., −14 dB to −16 dB, and as a result the degree of audibility and overall comb filtering effect caused by reflected sounds in the listening area is decreased to below a noticeable (hearing) level.

Figure 8A:
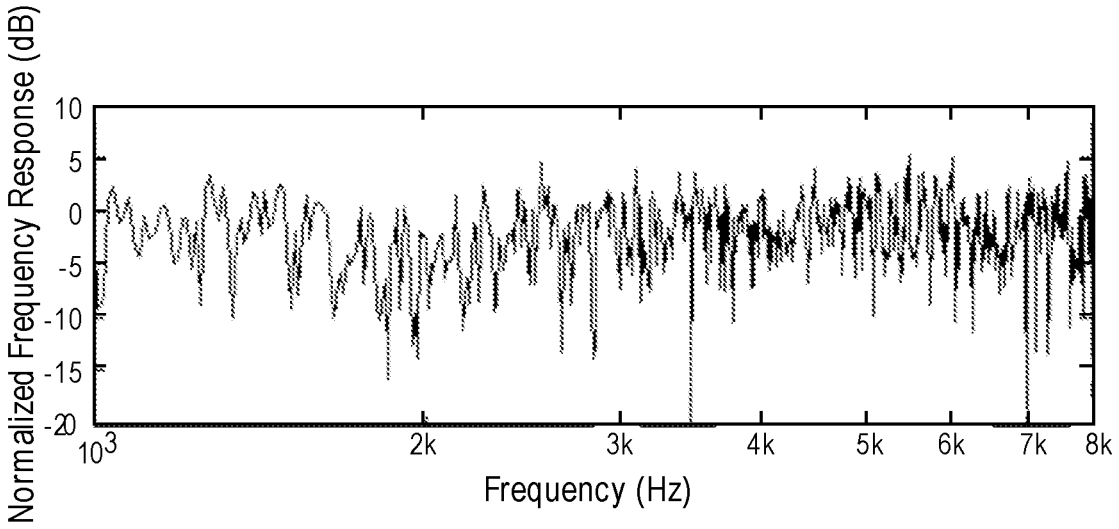
FIG. 8A shows a frequency response in the range of 1kHz to 8 kHz that corresponds to the time response of the wide polar pattern emission.
Figure 8B:
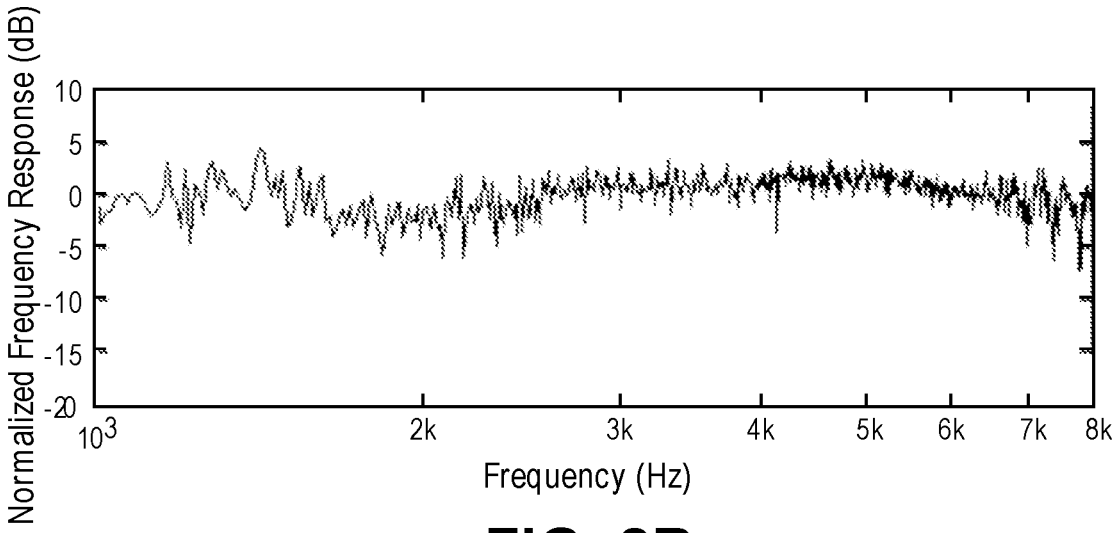
FIG. 8B shows a frequency response in the range of 1 kHz to 8 kHz that corresponds to the time response of the narrow polar pattern emission.

FIG. 8A shows the effect on frequency response (as measured by the microphone 13) of comb filtering that may be due to a wide polar beam pattern (or low directivity ratio) sound emission by the loudspeaker array 3. This may also be viewed as a frequency domain representation of the low directivity time response shown in FIG. 7. FIG. 8B shows how the comb filtering effect (deep drops in amplitude repeating at a fixed frequency interval) is reduced due to the narrow polar beam pattern (or high directivity ratio) sound emission regime—FIG. 8B may be viewed as the frequency domain representation of the high directivity time response shown in FIG. 7.

In one embodiment, the surface detector 14 may calculate the adjusted directivity ratio based on preset directivity settings. For example, in response to detecting an average −9 dB difference between the direct sound and the reflected sounds in a listening area 1 (e.g., over a certain time interval that starts at the detected, direct sound, such as 15 msec, or 20 msec), the surface detector 14 may perform a table look-up using the −9 dB value, to find a corresponding, adjusted directivity ratio. The look-up table may be stored in a memory unit of the directivity adjustment device 2. In one embodiment, the surface detector 14 may then trigger the test sound signal generator 9 to generate a set of input driver signals to drive the transducers of the loudspeaker array 3, which signals are designed to yield new test sounds having the calculated adjusted directivity ratio or adjusted polar pattern that has been obtained via the table look-up. The loudspeaker array 3 emits the new test sounds throughout the listening area 1, which are sensed by the microphone 13. The surface detector 14 may then recalculate differences between the direct and reflected sounds (in the sensed, new test sounds), and again checks or determines if the reflections are within an acceptable range (e.g., smaller than the predefined amplitude level as described above, or falling within a range, such as −14 dB to −16 dB.) If the reflections are not within an acceptable range, the surface detector 14 may calculate or lookup another, new adjusted directivity ratio, at which the loudspeaker array 3 will emit new test sounds, and the above-described process may repeat until the detected, reflected sounds are sufficiently controlled (or lie within an acceptable range.) Once this point has been reached, the process for selecting an "optimal" polar pattern or directivity ratio (the "adjusted" directivity ratio or polar pattern) for the loudspeaker array 3 that is intended for reducing the impact of early reflections and comb filtering, while maximizing diffuse sound in the listening area 1, may be deemed complete.

In one embodiment, the surface detector 14 may independently adjust horizontal and vertical directivity settings, including the angle of principal radiation of the loudspeaker array 3, based on the calculated amplitude variances or differences. For example, in the example shown above in FIG. 7, the reflected sound peaks D and F correspond to the ceiling and floor in the listening area 1, whereas reflected sound peak H corresponds to walls in the listening area 1. In this situation, the surface detector 14 may increase the vertical directivity of the loudspeaker array 3 by a certain amount, so as to lessen ceiling and floor reflections, while also increasing the horizontal directivity albeit by a different amount (to lessen the wall reflections.)

Consider the case where the loudspeaker array 3 is emitting at a directivity setting which results in the variances between the principal reflected sound peaks and the direct sound peak to be between −22 dB to −12 dB (in the example of FIG. 7), but the particular reflections at F and H exceed by too much a predefined threshold (e.g., −15 dB.) As explained above, this directivity setting is interpreted as being unacceptably low, by the surface detector 14, and as a result the surface detector 14 will seek to increase the directivity of the loudspeaker array 3 (to lessen the reflections F and H.) In one embodiment, the directivity of the loudspeaker array 3 may be incrementally increased until the reflection levels of interest on average decrease to "just above", e.g., 1 dB above, or "just below", e.g., 1 dB below, the predefined threshold (of −15 dB.)

The reflection levels of interest may be, e.g., variances between the direct sound amplitude level and the individual reflected sound amplitude levels at F and H, for example, or they may be the variances between the direct sound amplitude level and the average of the amplitude levels of all peaks in the recorded audio that are attributed to all reflected sounds within a predefined time period (e.g., up to 15 msec, or 20 msec), in relation to the earliest peak that is associated with the direct sound. For example, a test sound beam is selected that results in an average of the amplitude levels of all reflected sound peaks in the recorded audio being decreased to be at least 15 dB below the amplitude level of the direct sound within 20 milliseconds of the start of the direct sound; in one embodiment, that average is decreased to be within −14 to −16 dB (or 15 dB+/−1 dB.)

In another instance, the present directivity setting may result in the reflections D and G being interpreted as being too weak (too far below the −15 dB threshold), and as a result the directivity should be reduced. The surface detector 14 in that case may decide to incrementally decrease the directivity of the loudspeaker array 3, until the reflections (variances between the direct sound amplitude level and the reflected sounds amplitude levels) have risen to "just above", e.g., 1 dB above, or "just below", e.g., 1 dB below, the predefined threshold (of −15 dB.) In one embodiment, when the directivity of the speaker array is adjusted by decreasing it, doing so increases an amplitude level of a reflected sound peak in the recorded audio, over a predefined time period in relation to the direct sound, which peak is attributed to reflection off a surface (e.g., ceiling or floor.) The directivity is decreased until the amplitude level of the reflected sound peak is no more than 1 dB higher or no more than 1 dB lower than a predefined amplitude level.

By decreasing or increasing the directivity of the loudspeaker array 3 in this controlled or limited manner so that the early reflections are brought close to a predefined threshold level (within a tight tolerance, such as +/−1 dB around −15 dB), the surface detector 14 finds the directivity that increases the amount of diffuse sound produced by the loudspeaker array 3 while still maintaining a desirably low amount of sound directed at the reflection surfaces; such "dual action" response to the detected reflection levels results in the directivity being controlled in an advantageous manner that keeps comb filter effects to a reduced level but also maintains a certain level of diffuse sound, based on a carefully selected predefined threshold with a tight tolerance, despite changes in the location of the loudspeaker array 3.

The "final" or "optimal" adjusted directivity ratio or adjusted polar pattern that is calculated by the surface detector 14 during the measurement phase, as described above, is then fed to the content processor 15 (see FIG. 5), which produces the transducer input driver signals of the loudspeaker array 3 in accordance therewith, to output the user's sound program content through the loudspeaker array 3 in the listening area 1. Note here that the content processor 15 may alternatively be part of a separate and distinct audio receiver or external audio source that is driving the loudspeaker array 3 (and can produce the correct transducer input driver signals in accordance with the adjusted directivity ratio or polar beam pattern.) In either instance, the result is that the content processor 15 processes or renders the sound program content according to the adjusted directivity, such that the sound program content as output by the loudspeaker array 3 in the listening area 1 does not result in too much reflection off the surfaces 5 that would generate a perceivable or disruptive comb filtering effect.

In one embodiment, the directivity adjustment device 2 may operate at initial configuration and installation of the loudspeaker array 3 in the listening area 1. For example, the directivity adjustment device 2 may perform its measurement operation followed by the control operation (to set an adjusted directivity ratio for the content processor 15) each time the location of the target 8 in the listening area changes.

Figure 9:
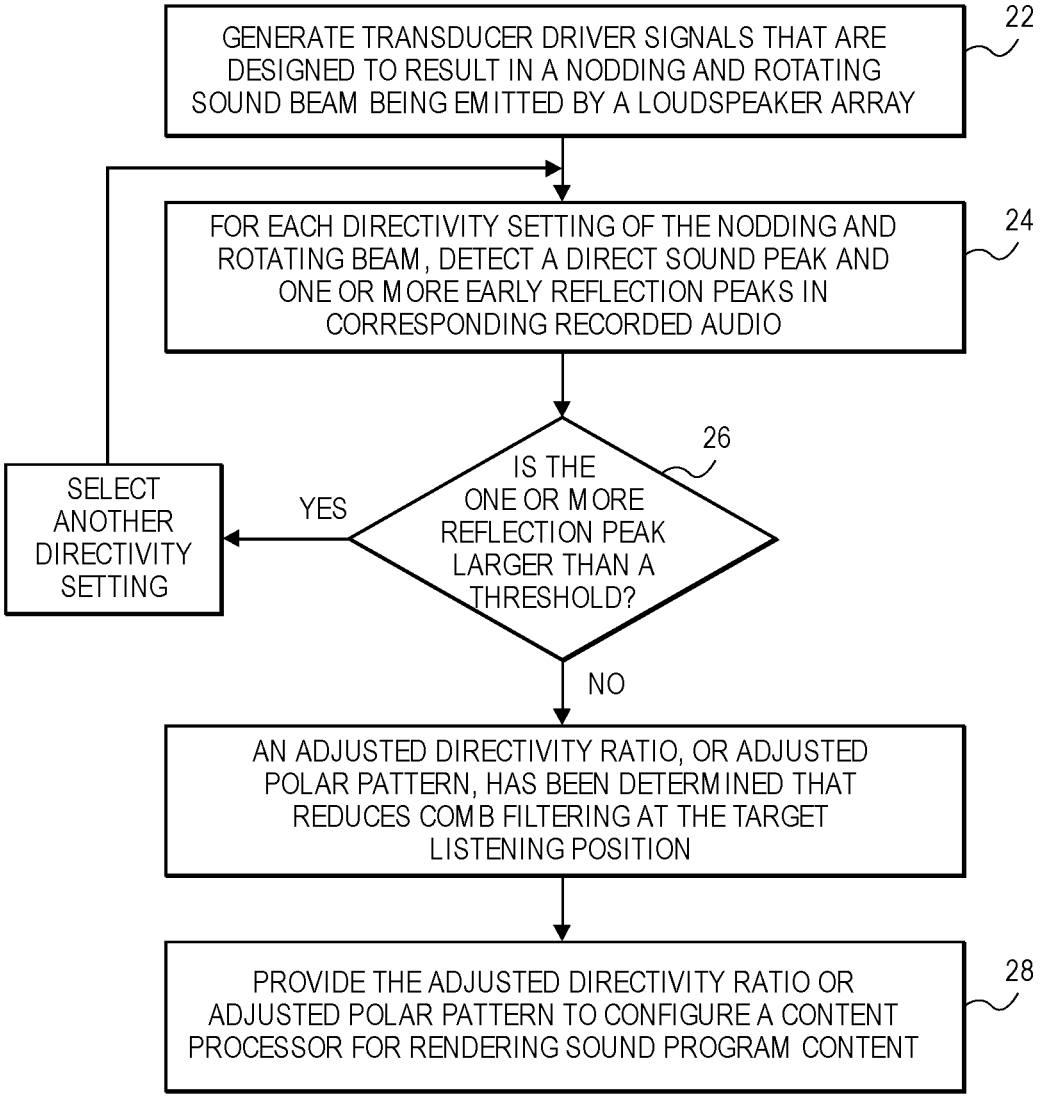
FIG. 9 is a flow diagram of the measurement and control operations that result in a reduction of comb filtering effects at a listening position but without unduly reducing the diffuse sound.

FIG. 9 shows a flow diagram of an embodiment of the measurement process performed by a programmed processor, as described above. Transducer driver signals for causing test sounds to be emitted throughout a listening area by a loudspeaker array are generated, which will result in a nodding and rotating sound beam that is defined by several different directivity settings (operation 22.) For each of the settings of the nodding and rotating beam, i) peaks of a microphone signal, in which the test sounds and their reflections in the listening area have been sensed, are detected, wherein the peaks represent a direct sound and one or more reflections thereof (operation 24.) The process determines whether or not the one or more peaks that represent reflections are larger than a predefined threshold (operation 26.) An adjusted directivity ratio or adjusted polar pattern for the loudspeaker array is determined (calculated, selected or found), based on finding that one of the directivity settings results in reflections that are smaller than the predefined threshold. The adjusted directivity ratio or adjusted polar pattern is then provided to configure a content processor (operation 28), and the latter so configured renders sound program content, according to the adjusted directivity ratio or the adjusted polar pattern, for output by the loudspeaker array in the listening area.

In another embodiment, the programmed processor accesses recorded test sound beams that were produced by a loudspeaker array in a listening area, and detects a surface in the listening area by processing the recorded test sound beams, wherein an instance of the surface is detected as an early reflection peak (e.g., with 20 msec of a direct sound peak) in each of the recorded test sound beams. Based on the detected surface, the processor calculates an adjusted directivity ratio or adjusted polar pattern for the loudspeaker array that reduces the amount of sound directed by the loudspeaker array at the surface. The test sound beams may be generated so as to scan the listening area in a nodding and rotating manner. The surface may be detected by detecting a direct sound as represented by the earliest peak above background noise in the recorded sound beams, and detecting a reflected sound corresponding to the surface, wherein the reflected sound is represented by a lower amplitude peak in the recorded sound beams. As the directivity of the test sound beams increases, the amplitude level of the detected reflected sound decreases due to a reduced amount of sound being directed at the surface. In contrast, as directivity of the test sound beams decreases, the amplitude level of the detected reflected sound increases, and this may occur until an adjusted directivity ratio or adjusted polar pattern is reached when the amplitude level of the detected reflected sound is within −14 dB to −16 dB in relation to that of the direct sound.

In accordance with another embodiment of the invention, a programmed processor may perform the following method for adjusting audio emitted by a speaker array. The method comprises outputting, by the speaker array, a plurality of audio test signals as sound beams, into a room along different angles or directions; recording, by an omnidirectional microphone, audio produced by the outputted audio test signals; detecting a ceiling surface and a floor surface in the room based on the recorded audio, e.g., by detecting a first peak representing an early ceiling reflection, and a second peak representing an early floor reflection; and adjusting the vertical directivity of the speaker array to avoid the detected ceiling and floor surfaces, e.g., by selecting a vertical directivity setting of the test signal that results in the first peak and the second peak having amplitude levels (in relation to an earliest peak representing direct sound) that are below a predefined threshold, e.g., within −14 dB to −16 dB in relation to the highest or earliest peak that represents the direct sound. The detection of the surfaces may comprise detecting direct sounds in the recorded audio, wherein the direct sounds are represented by the highest amplitude peak in the recorded audio; and detecting reflected sounds in the recorded audio, wherein the reflected sounds are represented by lower amplitude peaks in the recorded audio. Adjusting the vertical directivity of the speaker array may comprise increasing the directivity of the speaker array, which decreases the amplitude levels of the detected reflected sounds in the recorded audio. The amplitude levels of the reflected sounds may be decreased in this manner, to be less than a predefined amplitude level (e.g., below −15 dB, or within −14 dB to −16 dB, over a predefined time period (e.g., 15 msec, or 20 msec) in relation to the peak representing direct sound. The amplitude levels of the reflected sounds may be decreased to be less than 15 dB below the amplitude levels of the direct sounds, within 15 msec, or 20 milliseconds, of the start of the direct sounds. Adjusting the vertical directivity of the speaker array may also comprise: decreasing the directivity of the speaker array to increase the amplitude levels of the detected reflected sounds in the recorded audio to be 1 dB less or 1 dB more than a predefined amplitude level, over a predefined time period, in relation to the direct sounds, where this helps avoid directly reflecting the sound off the floor and off the ceiling surfaces, while minimizing the directivity of the speaker array (or keeping it small enough) to also ensure diffuse sound is heard properly in the listening area. The method may be performed at initial configuration of the speaker array in the room, for example each time there is a different target listening position relative to the loudspeaker array.

As explained above, an embodiment of the invention may be an article of manufacture in which a machine-readable medium (such as microelectronic memory) has stored thereon instructions which program one or more data processing components (generically referred to here as a "processor") to perform the digital signal processing portions of the measurement and control operations described above. In other embodiments, some of these operations might be performed by specific hardware components that contain hardwired logic (e.g., dedicated digital filter blocks and state machines). Those operations might alternatively be performed by any combination of programmed data processing components and fixed hardwired circuit components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A method for adjusting sound emitted by a speaker array, comprising:

emitting, by the speaker array, a nodding and rotating set of test sounds into a listening area;

recording, by a microphone, audio produced by the nodding and rotating set of test sounds in the listening area;

detecting a surface in the listening area based on the recorded audio; and adjusting a polar beam pattern that is output by the speaker array to reduce an amount of sound directed by the speaker array at the surface.

2. The method of claim 1, wherein detecting the surface comprises:

detecting a direct sound in the recorded audio, wherein the direct sound is represented by the earliest amplitude peak above background noise in the recorded audio; and detecting a reflected sound corresponding to the surface in the recorded audio, wherein the reflected sound is represented by a lower amplitude peak in the recorded audio that is lower than the earliest amplitude peak.

3. The method of claim 2, wherein adjusting the polar beam pattern comprises:

decreasing a width of the polar beam pattern that is output by the speaker array, wherein doing so decreases an amplitude level of reflected sound in the recorded audio that is attributed to reflection off the surface.

4. The method of claim 3, wherein an average of the amplitude level of all peaks in the recorded audio that are attributed to all reflected sounds in the recorded audio is decreased to a predefined amplitude level over a predefined time period in relation to the direct sound.

5. The method of claim 3, wherein an average of the amplitude level of all peaks in the recorded audio that are attributed to all reflected sounds in the recorded audio is decreased to be at least 15 decibels below the amplitude level of the direct sound within 20 milliseconds of the start of the direct sound.

6. The method claim 2, wherein adjusting the polar beam pattern comprises:

adjusting a horizontal polar radiation pattern or a vertical polar radiation pattern of the speaker array.

7. The method of claim 2, wherein adjusting the polar beam pattern:

increasing a width of the polar beam pattern wherein doing so increases an amplitude level of reflected sound in the recorded audio that is attributed to reflection off the surface to no more than 1 decibel higher than or no more than 1 decibel lower than a predefined amplitude level over a predefined time period in relation to the direct sound.

8. The method of claim 1, wherein the method is performed at initial configuration of the speaker array in the listening area.

9. The method of claim 1, wherein the surface is one of a ceiling, floor, or wall in the listening area.

10. A directivity adjustment device, comprising:

a processor; and memory having stored therein instructions that when executed by the processor generate transducer driver signals for causing test sounds to be emitted throughout a listening area by a loudspeaker array, in a nodding and rotating beam that is defined by a plurality of directivity settings, for each of the plurality of directivity settings of the nodding and rotating beam, i) detect a plurality of peaks of a microphone signal, in which the test sounds and their reflections in the listening area have been sensed, wherein the peaks represent a direct sound and one or more reflections thereof, and ii) determine whether or not the one or more peaks that represents reflections are larger than a predefined threshold, determine an adjusted polar beam pattern for the loudspeaker array based on finding that one of the plurality of directivity settings results in reflections that are smaller than the predefined threshold, and providing the adjusted polar beam pattern to configure a content processor to render sound program content according to the adjusted polar beam pattern, for output by the loudspeaker array in the listening area.

11. The directivity adjustment device of claim 10, wherein an earliest in time amplitude peak above background noise is associated with direct sound, and one or more lower amplitude peaks subsequent in time are associated with reflections of the direct sound.

12. The directivity adjustment device of claim 10, wherein determining the adjusted polar beam pattern includes adjusting horizontal directivity component and a vertical directivity component.

13. The directivity adjustment device of claim 10, wherein determining the adjusted polar beam pattern comprises narrowing the polar beam pattern when variance between i) amplitude level of the peak associated with the direct sound and ii) amplitude levels of the one or more peaks associated with reflections, are above the predefined threshold.

14. The directivity adjustment device of claim 10, wherein the adjusted polar beam pattern is calculated to widen the polar beam pattern of the loudspeaker array when variance between i) amplitude level of the peak associated with the direct sound and ii) amplitude levels of the one or more peaks associated with reflections, are below the predefined threshold.

15. The directivity adjustment device of claim 10, wherein the predefined threshold is between −14 dB to −16 dB.

16. An article of manufacture, comprising:

a non-transitory machine-readable storage medium that stores instructions which, when executed by a processor in a computer, access a plurality of recorded test sound beams that are produced by a loudspeaker array in a listening area;

detect a surface in the listening area by processing the recorded test sound beams, wherein an instance of the surface is detected as an early reflection peak in each of the recorded plurality of test sound beams; and based on the detected surface, calculate an adjusted polar beam pattern for the loudspeaker array that reduces the amount of sound directed by the loudspeaker array at the surface.

17. The article of manufacture of claim 16, wherein the storage medium includes further instructions which when executed by processor generate the test sound beams to scan the listening area in a nodding and rotating left-right manner.

18. The article of manufacture of claim 16, wherein the instructions in the storage medium cause the processor to detect the surface by detecting a direct sound as represented by the earliest peak above background noise in the recorded sound beams; and detecting a reflected sound corresponding to the surface, wherein the reflected sound is represented by a lower amplitude peak in the recorded sound beams.

19. The article of manufacture of claim 18, wherein as the test sound beams are narrowed, the amplitude level of the detected reflected sound decreases due to a reduced amount of sound being directed at the surface.

20. The article of manufacture of claim 18, wherein as the test sound beams are widened, the amplitude level of the detected reflected sound increases, until the adjusted polar beam pattern is reached when the amplitude level of the detected reflected sound is within −14 dB to −16 dB in relation to that of the direct sound.

* * * * *